United States Patent [19]

Leithner

[11] Patent Number: 4,909,843

[45] Date of Patent: Mar. 20, 1990

[54] HIGHLY WEAR-RESISTANT IRON-NICKEL-COPPER-MOLYBDENUM SINTERED ALLOY WITH ADDITION OF PHOSPHOROUS

[75] Inventor: Karl Leithner, Rankweil, Austria

[73] Assignee: Etablissement Supervis, Vaduz, Liechtenstein

[21] Appl. No.: 104,654

[22] Filed: Oct. 2, 1987

[30] Foreign Application Priority Data

Oct. 4, 1986 [DE] Fed. Rep. of Germany ..... 3633879

[51] Int. Cl.[4] ..... C22C 29/06

[52] U.S. Cl. ..... 75/237; 75/243; 75/246; 420/9; 420/92; 420/93; 420/99; 420/119; 420/123

[58] Field of Search ..... 75/237, 243, 246; 420/9, 92, 93, 99, 119, 123

[56] References Cited

U.S. PATENT DOCUMENTS

| | | | |
|---|---|---|---|
| 3,806,325 | 4/1974 | Nilmi et al. | 75/231 |
| 3,837,816 | 9/1974 | Takahashi et al. | 75/231 |
| 4,170,474 | 10/1979 | Chen | 75/231 |
| 4,253,874 | 3/1981 | Cundill | 75/237 |
| 4,268,309 | 5/1981 | Serino et al. | 75/237 |
| 4,345,942 | 8/1982 | Takahashi et al. | 75/231 |
| 4,345,943 | 8/1982 | Takahashi et al. | 75/231 |
| 4,348,232 | 9/1982 | Hiraoka et al. | 75/231 |
| 4,664,706 | 5/1987 | Drozda | 75/237 |
| 4,702,771 | 10/1987 | Takagi et al. | 75/237 |

FOREIGN PATENT DOCUMENTS

| | | | |
|---|---|---|---|
| 57-67148 | 4/1982 | Japan | 75/231 |
| 58-81954 | 5/1983 | Japan | 75/231 |
| 60-152658 | 8/1985 | Japan | 75/237 |
| 60-169541 | 9/1985 | Japan | 75/237 |

*Primary Examiner*—Stephen J. Lechert, Jr.
*Attorney, Agent, or Firm*—Toren, McGeady & Associates

[57] ABSTRACT

A highly wear-resistant sintered alloy is to be provided, with which, using conventional sintering technology and no additional hardening treatment, commodity parts are to be produced, which, in respect to their wear property are to be equivalent to chilled cast iron parts. They should have a surface roughness of approximately 50 Rockwell and only a slight shrinkage. This is accomplished with an iron-nickel-copper-molybdenum sintered alloy with addition of phosphorus, which contains a proportion of carbon, which exceeds the phosphorus added by at least a factor of 2. Essentially, the alloy has the following composition:

1.0–5.0% (by weight) of nickel (Ni)
1.0–3.0% (by weight) of copper (Cu)
0.3–1.0% (by weight) of molybdenum (Mo)
0.3–0.6% (by weight) of phosphorus (P)
1.0–2.5% (by weight) of carbon (C)
remainder: iron (Fe)

6 Claims, 1 Drawing Sheet

HIGHLY WEAR-RESISTANT IRON-NICKEL-COPPER-MOLYBDENUM SINTERED ALLOY WITH ADDITION OF PHOSPHOROUS

BACKGROUND OF THE INVENTION

The invention is directed to a highly wear-resistant iron-nickel-copper-molybdenum sintered alloy which also contains phosphorus.

The method of making highly wear-resistant machinery components from chilled cast iron is well known. Chilled cast iron is an iron-carbon alloy, in which the carbon and silicon contents, aside from the other elements of manganese, phosphorus and sulfur, as well as the nickel and chromium contents are adjusted so that the cast piece solidifies either completely white due to cooling in foundry sand or with only a surface layer white, due to the action of quenching plates. The carbon is thus not precipitated as graphite. The structure consists then of ledeburite with cementite or disintegrated austenite. Chilled cast iron belongs to the best known, most highly wear-resistant alloys. The wear resistance is generally attained due to the cementite and less frequently due to the martensite. The latter can be obtained by appropriately alloying or by quenching. Chilled cast iron practically cannot be deformed.

Although this material has proven to be very successful for highly wear-resistant machine components, it does have the disadvantage that the production of chilled cast iron parts cannot yet be automated. The production of such parts is thus very expensive, especially if the parts are commodity articles, which must be produced in large numbers.

Powder metallurgy has proven to be successful for the production of commodity articles with designated and specified properties. For producing high-strength workpieces by this technique, an iron-molybdenum-nickel sintered alloy with addition of phosphorus was developed (German Pat. No. 2,613,255, Austrian Pat. No. 361,959). The objects, produced from this alloy, have a tensile strength of 600 $N/mm^2$ and higher. These parts are produced using the simple sintering technique and, moreover, without an additional heat treatment. Admittedly, workpieces produced from these alloys attain the desired tensile strength; however, they do not attain the wear resistance of chilled cast iron parts.

For cams of cam shafts, for which a high wear resistance is required, a sintered alloy was developed, which contains chromium, molybdenum, copper, phosphorus and carbon (British Offenlegungsschrift 2,073,247, Höganaes PM seminar report of March 1985). Comparison tests were carried out, in which chilled cast iron cam shafts and cam shafts with sintered cams of the aforementioned material were subjected to the same testing conditions. The wear values, so obtained, are of comparable orders of magnitude. However, the sintered alloy used here cannot be produced simply by mixing the corresponding elementary metal powders, but must be used as a prealloyed powder, because of the high oxygen affinity of chromium. If elementary chromium were to be mixed in as a powder, an oxide casing would form around the particles before the actual sintering process, because the inert gases used in industry generally are contaminated with oxygen. The oxide casing prevents the diffusion-controlled alloying process.

For the production of prealloyed powders, an alloy of the desired composition is fused and, according to the usual method, atomized to a powder. By carrying out this process under a inert gas of high purity, it is made certain that the element chromium, which has a high affinity for oxygen, dissolves in the alloy. The powder, so obtained, is mixed with elementary carbon (graphite), pressed and sintered. During the sintering process, the chromium forms carbides, which appreciably improve the wear resistance. The interaction of phosphorus and carbon causes a liquid phase to be formed and thus increases the sintering activity.

Parts produced from this prealloyed iron powder have a high shrinkage. The particles of the powder are very hard and can therefore be compressed only with difficulty. Shrinkage in the longitudinal direction is of the order of 5%. In the production of cams for cam shafts, this shrinkage is not entirely undesirable, because it causes the cam to be seated firmly on the shaft. On the other hand, because of the high shrinkage, close tolerances can be adhered to only at great expense, if at all. The production of a prealloyed powder is a sophisticated and therefore expensive process.

SUMMARY OF THE INVENTION

It is therefore an object of the invention to provide a highly wear-resistant iron-nickel-copper-molybdenum sintered alloy with addition of phosphorus, with which, employing an essentially normal sintering technique and no additional hardening treatment, commodity parts can be produced, which are equivalent to chilled cast iron parts with respect to their wear properties. They should thus have a surface harness of 50 Rockwell (RC) and only a slight shrinkage. In other words, the powder must be readily compressible. At the same time, the workpiece, produced with this sintered alloy, should retain the character associated with powder metallurgical manufacture and thus have a not inconsiderable proportion of pores, which experience has shown to have a positive effect on emergency running properties. Pursuant to the invention, the sintering alloy to solve this complex task is characterized by the fact that it contains a proportion of carbon (by weight), which is at least twice as high as the amount of phosphorus added. Advisably, the proportion of carbon in this sintered alloy is about three to five times as high as the the amount of phosphorus added.

DESCRIPTION OF THE INVENTION

In particular, the sintered alloy of the invention is characterized by the following composition:

1.0–5.0% (by weight) of nickel (Ni)
1.0–3.0% (by weight) of copper (Cu)
0.3–1.0% (by weight) of molybdenum (Mo)
0.3–0.6% (by weight) of phosphorus (P)
1.0–2.5% (by weight) of carbon (C)
remainder: iron (Fe)

Commodity parts, produced from this alloy, do not have to be subjected to a hardening process. They already have a surface hardness of the order of about 50 Rockwell (RC) and only a slight shrinkage or only a slight growth. They furthermore have the character of a workpiece produced by powder metallurgical means. This means that they have a relatively high proportion of pores, which favors the emergency running properties. The components forming the sintered alloy are mixed in the elementary form with iron powder or diffusion alloyed. The powder, so obtained, is shaped in the compression mold to the desired part under pressure, for example, under pressures of 400–1000 N/mm$^2$ and subsequently sintered for about thirty minutes at 1120° C. The sintering process is carried out in the well-known manner in essentially three immediately consecutive time phases, namely the evaporation of the lubricant, the actual sintering and the cooling. These processes are conducted under an inert gas. The good compressibility is ensured owing to the fact that the components of the prealloyed powder are present in elementary form, so that the good ductility of pure metals can be utilized.

The following examples explain the invention in greater detail. These examples show the exact composition of the alloys, the compressed density achieved of the blank, as well as the surface hardness obtained, which was measured by standardized methods.

EXAMPLE 1:

| Nominal analysis | |
|---|---|
| C | 1.5% |
| Cu | 1.5% |
| Ni | 4% |
| Mo | 0.5% |
| P | 0.45% |
| Fe | remainder |
| annealing temperature: | 175° C. |
| annealing time: | 60 minutes |
| nominal density: | 7.0 g/cc |
| hardness HV 5 = | 520 |

Figure 1:
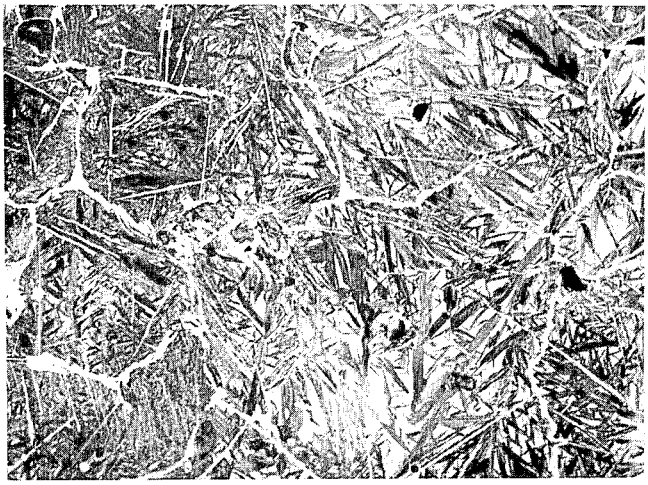
FIGS. 1 and 2 are photomicrographs (500X magnification) of sintered alloys of the invention.

FIG. 1 shows as photomicrograph (500X magnification). The polished surface was produced in the usual manner. This alloy has small rounded pores. The pores are mainly on the grain boundaries marked by the cementite network. At various places, there are smaller pores in the middle of the grain.

The cementite network can be identified in the photomicrograph as a white network. It encloses almost all grains. Its thickness is less than 3 μm; at most places, the thickness is of the order of 1 μm. The white dots, which can be seen at a few places in the interior of the grain, are cementite spheres.

The structure of the grains comprises acicular (needle-shaped)martensite, which is embedded in the residual austenite. The martensite appears in the form of dark needles, the residual austenite is bright and lies between the needles. Corresponding to FIG. 1, this alloy is expected to contain 40% by volume of residual austenite. Accordingly, austenite-rich areas (bright spots in FIG. 1), which are intersected in parts by the cementite network, constitute 14% by volume. The light gray coloration of the residual austenite could indicate partial conversion into lower bainite due to the annealing treatment.

Residual austenite may have a disadvantageous effect on the dimensional stability of the components. Nevertheless, the appearance of residual austenite in the structure need not represent a disadvantage with respect to wear. As the proportion of residual austenite grows, the resistance to abrasive wear increases. The conversion of residual austenite into bainite represents an advantage in the case of sliding wear and tear. At the same hardness, the sliding wear properties of a bainitic structure are better than those of a martensitic structure.

The microload hardness tests revealed a hardness of 612 ±HV 0.05 for the martensitic grains. In areas with a high proportion of residual austenite (or lower bainite), the hardness is distinctly lower at 476±88.

EXAMPLE 2

| Nominal analysis | |
|---|---|
| C | 2% |
| Cu | 1.5% |
| Ni | 1.75% |
| Mo | 0.5% |
| P | 0.45% |
| Fe | remainder |
| annealing temperature: | 175° C. |
| annealing time: | 60 minutes |
| nominal density: | 7.0 g/cc |
| hardness HV 5 = | 520 |

Figure 2:
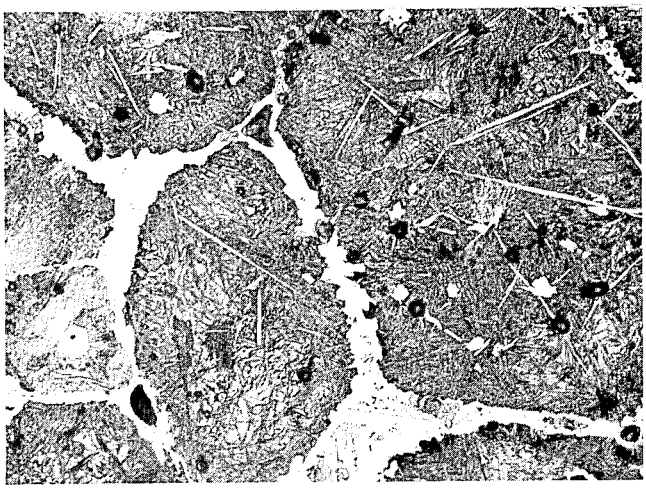

FIG. 2 shows the photomicrograph (500X magnification). The pores of this alloy are larger and more rounded than those of the alloy discussed first. They are preferably located at the grain boundary triple points, less frequently between two grains and in only a few cases in the interior of the grain. The fact that the pores are more rounded indicates that the liquid phase was more prominent during the sintering.

The cementite network is stronger here than in the first-discussed alloy. It encloses all grains. The thickness is 1 to 15 μm. Particularly broad areas of cementite network may be observed at the grain boundary triple points. The cementite grains, which occur occasionally in the alloy discussed first, occur increasingly here. Well-rounded cementite grains (hardness 1018±HV 0.025) may be observed in almost every grain. The grains themselves comprise the first-discussed alloy of acicular martensite with residual austenite. Areas rich in residual austenite are generally to be found in the interior of the grains; in some cases, there are also larger areas, which are formed by several adjacent grains and are separated only by the cementite network.

The martensitic areas are somewhat harder (680±69 HV 0.05) than those of the alloy discussed first. On the other hand, the areas rich in austenite are somewhat softer (353±36 HV 0.05). The cementite network has the expected hardness of 1035±67 HV 0.05.

I claim:

1. A highly wear resistant sintered alloy consisting of iron, nickel, copper, molybdenum, phosphorus and carbon, wherein the phosphorus is present in an amount of 0.3 to 0.6% by weight and the carbon is present in an amount by weight of at least two times that of phosphorus.

2. The highly wear resistant sintered alloy defined in claim 1, wherein the weight percent of carbon in the alloy is three to five times the weight percent of phosphorus.

3. The highly wear resistant sintered alloy defined in claim 1 or 2, wherein the alloy consists of in percent by weight:

| | |
|---|---|
| nickel | 1.0–5.0 |
| copper | 1.0–3.0 |
| molybdenum | 0.3–1.0 |
| phosphorus | 0.3–0.6 |
| carbon | 1.0–2.5 |

-continued

| | |
|---|---|
| iron | remainder. |

4. A highly wear resistant sintered alloy consisting of iron, nickel, copper, molybdenum, phosphorus and carbon, wherein carbon is present in an amount by weight of 1.0 to 2.5%, phosphorus is present in an amount of 0.3 to 0.6% by weight and wherein the carbon is present in an amount by weight of at least two times that of phosphorus.

5. The highly wear resistant sintered alloy defined in claim 4, wherein the weight percent of carbon in the alloy is three to five times the weight percent of phosphorus.

6. The highly wear resistant sintered alloy defined in claim 4 or 8, wherein the alloy consists of in percent by weight:

| | |
|---|---|
| nickel | 1.75–4.0 |
| copper | 1.5 |
| molybdenum | 0.5 |
| phosphorus | 0.3–0.6 |
| carbon | 0.45 |
| iron | remainder. |

* * * * *